US007704588B1

(12) United States Patent
Mrofka et al.

(10) Patent No.: US 7,704,588 B1
(45) Date of Patent: Apr. 27, 2010

(54) DECORATIVE TIE MEMBER AND METHOD OF USE THEREFOR

(75) Inventors: Elizabeth R. Mrofka, 2917 W. 81st Ave., Unit A, Westminster, CO (US) 80031; Kenneth W. House, Fort Collins, CO (US)

(73) Assignee: Elizabeth R. Mrofka

( * ) Notice: Subject to any disclaimer, the term of this patent is extended or adjusted under 35 U.S.C. 154(b) by 712 days.

(21) Appl. No.: 11/477,829

(22) Filed: Jun. 29, 2006

Related U.S. Application Data

(60) Provisional application No. 60/696,737, filed on Jul. 6, 2005.

(51) Int. Cl.
*B32B 3/24* (2006.01)
*B65D 63/00* (2006.01)

(52) U.S. Cl. ..... 428/136; 24/16 R

(58) Field of Classification Search ..... 428/136; 24/16 R

See application file for complete search history.

(56) References Cited

U.S. PATENT DOCUMENTS

| | | | | |
|---|---|---|---|---|
| 184,118 | A | 11/1876 | Taylor | |
| 925,694 | A | 6/1909 | Greenwood | |
| 1,281,586 | A | 10/1918 | Kolibas | |
| 1,722,908 | A | 7/1929 | Geiseler | |
| 2,643,424 | A | 6/1953 | Gothar | |
| 3,479,243 | A | 11/1969 | Doig | |
| 3,739,961 | A | 6/1973 | Soukeras | |
| 3,880,093 | A | 4/1975 | Schott | |
| 5,426,829 | A | 6/1995 | Hsiung | |
| D431,878 | S | 10/2000 | Holowich | |
| 6,182,388 | B1 * | 2/2001 | Patton | 40/640 |
| 6,694,575 | B1 * | 2/2004 | Martin | 24/306 |
| 2004/0034901 | A1 | 2/2004 | Trombetti | |
| 2005/0000136 | A1 | 1/2005 | Davis | |

* cited by examiner

*Primary Examiner*—William P Watkins, III
(74) *Attorney, Agent, or Firm*—Brian D. Smith, P.C.

(57) ABSTRACT

A decorative tie member for securing a ribbon about a gift package is disclosed. The tie member has an underside for placement against a package and a generally oppositely facing decorative surface. The tie member is provided with at least one inner opening and first and second outer openings. To secure a ribbon about a package with the tie member, a free end of the ribbon is threaded through an inner opening from the underside surface of the tie member to and through the exposed decorative surface of the tie member. The free end is then threaded back through the tie member through the tie member's first outer opening and the threading is continued until a desired excess portion of the ribbon has been threaded through the openings. The process is then repeated with the other free end of the ribbon through an inner opening and the second outer opening located on the other side of the tie member. Then, the now threaded free ends of the ribbon are grasped and pulled apart from each other to cinch the ribbon and tie member tightly against the package.

10 Claims, 3 Drawing Sheets

DECORATIVE TIE MEMBER AND METHOD OF USE THEREFOR

CROSS REFERENCE TO RELATED APPLICATION

This application is a nonprovisional application claiming the benefit under 35 USC 119(e) of U.S. provisional application No. 60/696,737, filed on Jul. 6, 2005.

TECHNICAL FIELD

The present invention relates generally to package ties and bands and, more particularly, to a decorative clasp or tie member for securing a ribbon, string, rope etc. about a gift package.

BACKGROUND OF THE INVENTION

As far as is known, no one has invented a decorative clasp or tie member for securing a ribbon about a gift package. U.S. Pat. Nos. 184,118; 925,694 and 1,281,586 disclose package ties and bands but they are not decorative nor do they provide a simple way of securing a ribbon about a gift package. U.S. Pat. No. 2,643,424 discloses a device for securing a ribbon to a gift package but the device itself is neither decorative nor even meant to be seen. Other references found in a search for material related to the present invention include U.S. Pat. Nos. 1,722,908; 3,479,243; 3,739,961; 3,880,093 and 5,426,829 and U.S. patent applications Nos. US 2004/0034901 and US 2005/0000136.

The above summary describes preferred forms of the present invention and is not in any way to be construed as limiting the claimed invention to the preferred forms.

BRIEF DESCRIPTION OF THE DRAWINGS

FIG. 4 is a perspective view of a tie member of the present invention for framing a photograph and the like.

DISCLOSURE OF THE INVENTION

The present invention provides a decorative clasp or tie member for securing a ribbon about a gift package. The tie member has an underside surface for placement against a package and a generally oppositely facing exposed decorative surface. The tie member is provided with inner opening means and first and second outer openings through which a ribbon, rope or string and the like is threaded as described below to secure the same to the gift package. The inner opening means extends through the tie member from its underside surface to its decorative surface and defines opposing first and second inwardly facing surfaces which also extend from the tie member's underside surface to its decorative surface.

The first and second outer openings are located on opposite sides of said tie member such that each defines opposing inwardly and outwardly facing side surfaces extending from the tie member's underside surface to its decorative surface. The opposing first and second side surfaces are also aligned with the opposing inwardly facing surfaces of the inner opening means and the first and second outer openings are further aligned with each other along an axis of the tie member such that the opposing side surfaces of the outer openings are generally perpendicular to the axis.

To secure a ribbon about a package, a free end of the ribbon is threaded through an inner opening means from the underside surface of the tie member to and through the exposed decorative surface of the tie member. The free end is then threaded back through the tie member through the tie member's first outer opening and the threading is continued until a desired excess portion of the ribbon has been threaded through the openings. The process is then repeated with the other free end of the ribbon through the inner opening means and the second outer opening located on the other side of the tie member. Then, the now threaded free ends of the ribbon are grasped and pulled apart from each other to cinch the ribbon and tie member tightly against the package.

In addition to the foregoing tie member and method for securing a ribbon to a package, the present invention includes a package tie assembly including a tie member and ribbon, rope string and the like for being secured about the package by the tie member.

DETAILED DESCRIPTION OF THE PREFERRED EMBODIMENTS

Figure 1:
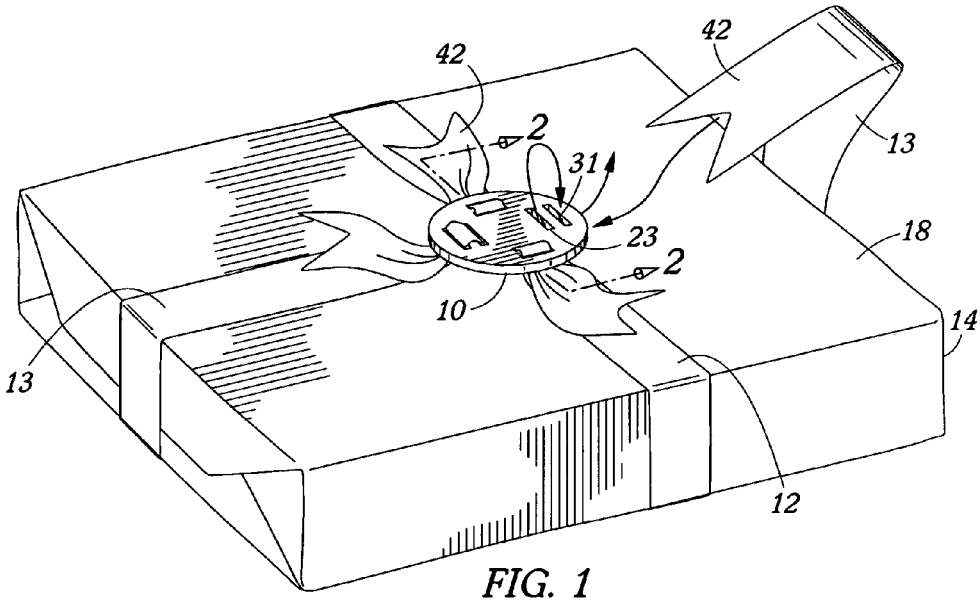
FIG. 1 is a perspective view of an embodiment of the present invention which illustrates a tie member of the present invention being used to secure a ribbon about a gift package.
Figure 2:
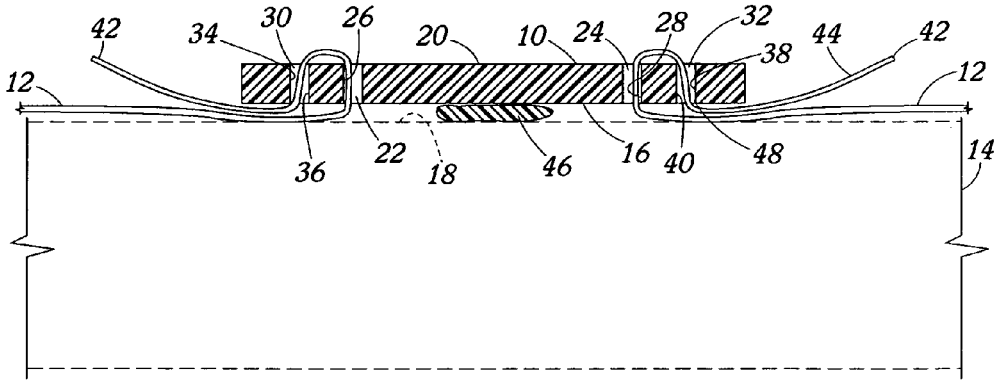
FIG. 2 is a cross-sectional view taken along lines 2-2 of FIG. 1.
Figure 3:
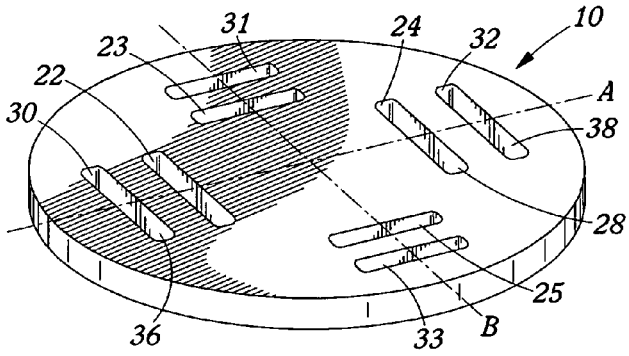
FIG. 3 is a perspective view showing the tie member of FIG. 1 in isolation.
Figure 1A:
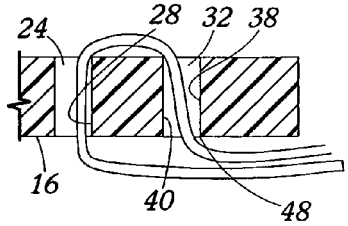
FIG. 1A is an enlarged view of the circled area of FIG. 1.

Referring now to the drawings, FIGS. 1 through 3 illustrate a tie member or body 10 of the present invention for securing two sections of ribbon 12, 13 to a package 14. As shown, tie member 10 is disc-shaped and provided with a generally flat underside surface 16 for placement against a generally flat surface 18 of package 14. In addition, it will be appreciated the tie member 10 has an exposed or upwardly facing decorative surface 20. Tie member 10 is also provided with a thickness of about a quarter to a half an inch to provide the tie member with an ornamental appearance.

To secure ribbons 12, 13 about the package as shown, tie member is provided with two sets of slots or openings, the details and numbering of which immediately follow. As best shown in FIG. 2, a pair of first and second inner slots 22, 24 for receiving ribbon 12 are provided which extend through the tie member from its flat underside surface 16 to its exposed decorative surface 20. As also shown, the first inner slot 22 defines a first inwardly facing side surface 26 and the second inner slot 24 defines a second inwardly facing surface 28. Surfaces 26, 28 are preferably parallel to each other as shown.

In addition, tie member 10 is provided with first and second outer slots 30, 32 which as shown are located on opposite sides of the tie member and which also extend through the tie member from its flat underside surface 16 to its exposed decorative surface 20. As also shown, the first outer slot 30 defines parallel inwardly and outwardly facing side surfaces 34, 36 while the second outer slot 32 defines parallel inwardly and outwardly facing side surfaces 38, 40. Surfaces 34-40 are all straight and parallel to each other and are also parallel to surfaces 26, 28 of the inner slots 22, 24. Outer slots outer slots 30, 32 as well as inner slots 22, 24 are also provided with a width which is greater than the thickness of ribbon 12 so that the ribbon can be threaded through the slots as described in more detail below. It will also be appreciated that the inner and outer slots are aligned with each other along an imaginary axis A of the tie member (shown in FIG. 3) such that the slots' side surfaces 26, 28 and 34-40 are perpendicular to the axis. As also shown, a second pair of inner and outer slots 23, 25 and 31, 33 are also provided in tie member 10 which are identical to slots 22, 24, 30 and 32 except that they are located along imaginary axis B of the tie member instead of axis A. As will be appreciated and as shown in FIG. 3, imaginary axis B intersects axis A at a 90 degree angle. As shown in FIGS. 1 and 2, ribbon 12 has been threaded through inner and outer slots 23, 25 and 31, 33.

To illustrate the process of threading tie member 10 with a ribbon, FIG. 1 is provided and as can be visualized from FIG. 1 to thread tie member 10 with a ribbon, its free end 42 is threaded through an inner and outer slot of the tie member in the direction shown by the arrows in FIG. 1. Accordingly and as shown, the free end 42 of ribbon 13 is first threaded through first inner slot 23 from the underside surface of the tie member to and through the exposed decorative surface of the tie member. The free end 42 is then threaded through the first outer slot 31 from the exposed decorative surface to and through the underside surface until a desired excess portion 44 of the ribbon has been threaded through the slots. The process is then repeated with the other free end of the ribbon through slots 25, 33. Then, the free ends 42 of the ribbon 13 are grasped and pulled apart from each other to cinch the ribbon and tie member tightly against the package. (As shown in FIGS. 1 and 2, slots 25, 33 are already threaded with the other end of ribbon 13).

The entire foregoing process is then repeated with ribbon 12 through inner and outer slots 22, 24 and 30, 32 which is already completed as shown in FIGS. 1 and 2. Accordingly, when ribbons 12 and 13 are fully threaded through their respective slots, the ribbons will be attached to each side of the tie member to provide the package with the illustrated pleasing decorative appearance. Finally, after tie member 10 is threaded with ribbons 12, 13, as discussed above, the excess portions 44 of the ribbons at the ribbon's free ends 42 may now be shaped or curled as is well known to those skilled in the art of gift wrapping.

While the aforementioned system will generally securely attach a ribbon about the gift package, it has been found that in some situations, particularly where the tie member is quite heavy, additional means of securing the tie member to the package is desirable. A preferred means for attaching the tie member directly to the gift package utilizes pressure sensitive adhesive 46 which is preferably applied to a central area of the underside surface of the tie member as shown in FIG. 1 and which secures the tie member to the gift package when the tie member is pressed against the package.

Figure 4:
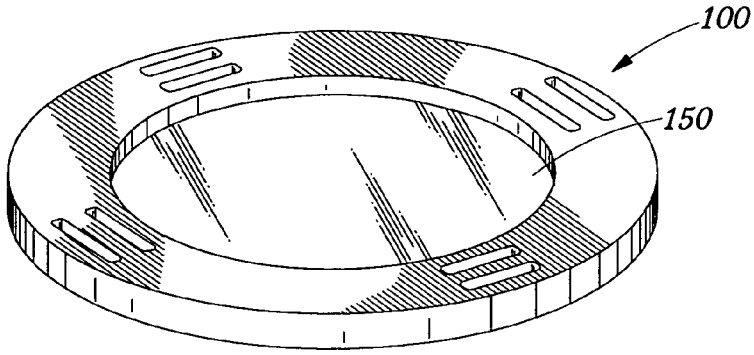

FIG. 4 illustrates a tie member 100 of the present invention which is very similar to that of FIGS. 1-3 except that tie member 100 is provided with a central circular shaped recessed area 150 for receiving a photograph (not shown) and the like.

Figure 5:
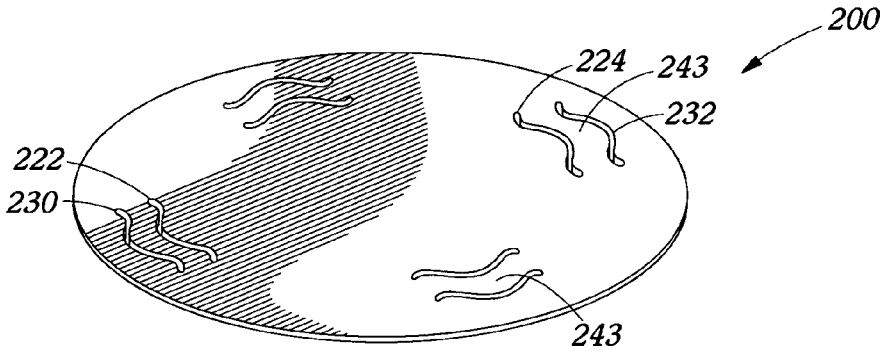
FIG. 5 is a perspective view of a tie member of the present invention provided with S-shaped slots.

FIG. 5 illustrates a tie member 200 of the present invention which is also very similar to that of FIGS. 1-3 except that tie member 200 is provided with a S-shaped slots 222, 224 and 230, 232 instead of the straight slots provided in the embodiment of FIGS. 1-3. In addition to providing a nice decorative shape, it is believed that the S-shaped slots may also help to prevent the ribbon from loosening after it is cinched tightly against the package as described above in connection with the embodiment of FIGS. 1-3. In addition, the likelihood of ribbon loosening may also be reduced by serrating an edge of the slots such as edge 48 of tie member 10.

Figure 6:
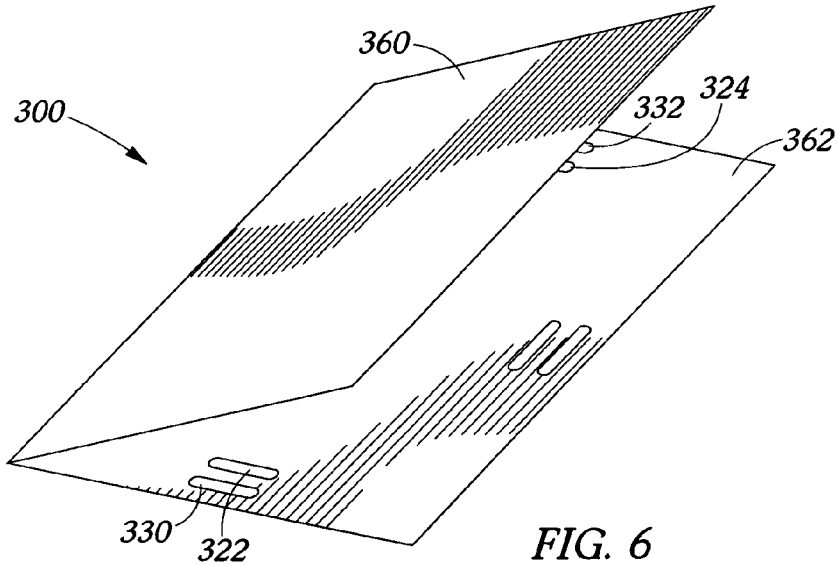
FIG. 6 is a perspective view of a tie member of the present invention provided in the form of a greeting card.
Figure 7:
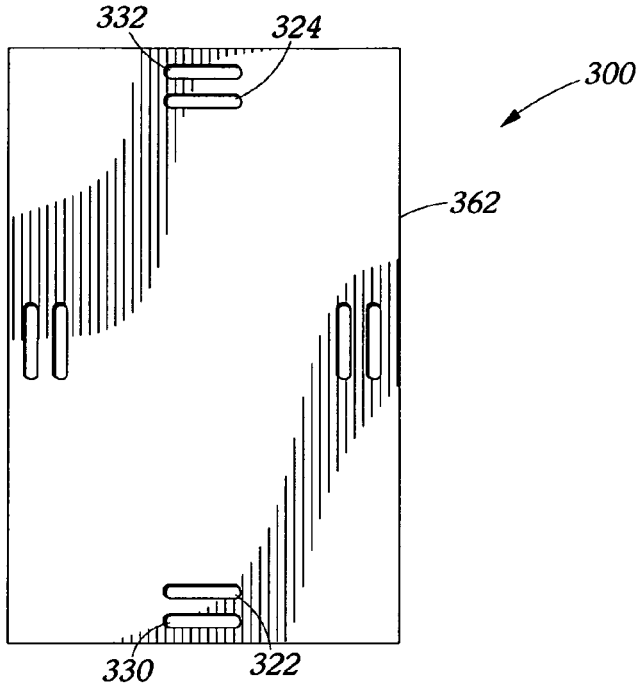
FIG. 7 is a bottom plan view of the tie member shown in FIG. 6.

FIGS. 6 and 7 illustrate yet another tie member 300 of the present invention which is provided in the form of a greeting card. As shown, greeting card tie member 300 has a front cover 360 and a back cover 362 and, as will be appreciated, greeting card messages can either printed or handwritten onto the card. As also shown, back cover 362 (as best shown in the backside view of FIG. 7) is provided with slots inner and outer slots 322, 324 and 330, 332 for receiving ribbons similar to those of FIGS. 1-3 to secure the card tightly against a package.

Figure 8:
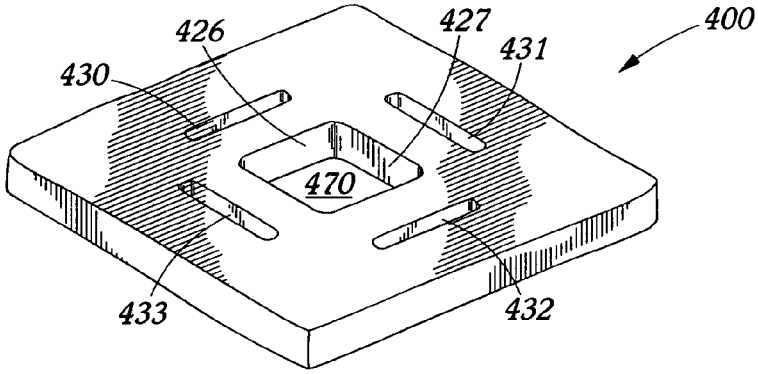
FIG. 8 is a perspective view of yet another tie member of the present invention.

FIG. 8 illustrates a tie member 400 of the present invention which is square shaped and provided with a central square opening 470 instead of inner slots as provided in the other illustrated embodiments. While provided with just a single square opening 470, it will be appreciated that square opening 470 serves the same function as the inner slots by providing an opening for receiving the free ends of the ribbons being threaded through the tie member as well as providing inwardly facing surfaces 426, 427 which the ribbons rest against when they are cinched tightly against the package to secure the square tie member to a package. It will be appreciated that FIG. 8 only shows inwardly facing surfaces 426, 427. However, the other surfaces defined by square opening 470 are also inwardly facing surfaces. The outer slots 430-433 shown in FIG. 8 are similar to those of FIGS. 1-3 and function similarly.

Figure 9:
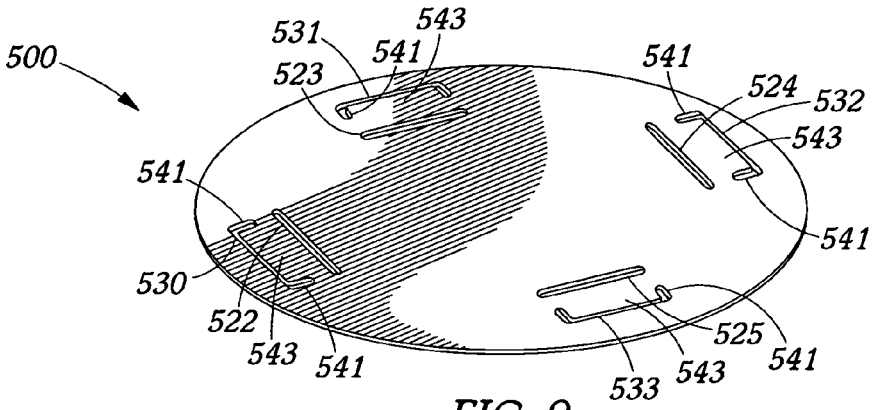
FIG. 9 is a perspective view of a flexible tie member of the present invention.

FIG. 9 illustrates another tie member 500 of the present invention which is preferably made out of a flexible plastic material such as that from which credit cards are made. Tie member 500 is provided with a first set of inner and outer slots 522, 524 and 530, 532 as well as second set of slots 523, 525 and 531, 533. In addition, it will be appreciated that the ends of outer slots 530-533 adjoin slits 541 at a right angle which extend inwardly from the ends of slots. Slits 541 allow the adjacent areas 543 of the tie member to be flexed downwardly when pressed. This flexing of an area 543 opens the adjacent slot slightly and thereby makes it easy to thread a ribbon through the slot, even if the slot's width is very narrow, even narrower than the thickness of a ribbon. The advantage of having such a narrow slot is that when the slot flexes back to its original resting position it will grip the ribbon slightly and thereby prevent the ribbon from loosening after it has been cinched tightly against a package, as described above in connection with the embodiment of FIGS. 1-3. Slits similar to slits 541 could also be provided on the inner slots. In addition, it is believed that tie member 200 of FIG. 5 could be made out of a flexible material such as a credit card. As such, it is believed that the adjacent areas 243 of tie member 200 could be pressed or flexed downwardly to widen the opening of the adjacent slots and thereby make it easier to insert the ribbon through an adjacent slot which would also grip the threaded ribbon when the area 243 is released.

While preferred embodiments of the present invention have been shown and described, it is to be understood that this was done only by way of example, and not as a limitation upon the scope of the invention. For example, while the slots illustrated in the embodiments are straight or curved they could be circular, oval or virtually any other shape as long as they are capable of being threaded by a ribbon or other type of tying member such as rope or string or perhaps even wire.

I claim:

1. A package tie assembly, comprising:

a strip of ribbon having a length including a main portion for wrapping around a package and excess portions located at the free ends of said ribbon for being formed into a decorative configuration; and, a generally planar decorative tie member having an underside surface for placement against a package and a generally oppositely facing decorative surface, said tie member defining:

inner opening means extending through said tie member from said underside surface to said decorative surface, said inner opening means defining opposing first and second inwardly facing surfaces which extend from said underside surface to said decorative surface, and a first and second pair of first and second outer slots located on opposite sides of said tie member wherein each of said first and second outer slots defines parallel inwardly and outwardly facing side surfaces extending from said underside surface to said decorative surface, said parallel first and second side surfaces also being parallel to said inwardly facing surfaces of said inner opening means, said first and second outer slots of each pair of said slots further being aligned with each other along an axis of said tie member such that the axes of said pairs of said outer slots intersect each other at a right angle.

2. A package tie assembly as claimed in claim 1 wherein said first and second outer slots of each pair of said outer slots are aligned with each other along said axis for said pair of outer slots such that said parallel side surfaces of said outer slots of said pair are perpendicular to said axis of said pair of outer slots.

3. A package tie assembly as claimed in claim 1 wherein said inner opening means includes first and second inner slots wherein said first inner slot defines said first generally parallel inwardly facing side surface and said second inner slot defines said second generally parallel inwardly facing surface.

4. A package tie assembly as claimed in claim 1 wherein said slots are straight.

5. A package tie assembly as claimed in claim 1 wherein said slots are curved.

6. A package tie assembly as claimed in claim 1 further comprising a slit adjoining a said slot.

7. A package tie assembly as claimed in claim 6 wherein a pair of said slits are provided which adjoin a said slot at the ends of the slot.

8. A package tie assembly as claimed in claim 7 wherein said slits adjoin the ends of the slot at a right angle.

9. A package tie assembly as claimed in claim 1 wherein said slots are identically shaped.

10. A package tie assembly, comprising:

a strip of ribbon having a length including a main portion for wrapping around a package and excess portions located at the free ends of said ribbon for being formed into a decorative configuration; and, a generally planar decorative tie member having an underside surface for placement against a package and a generally oppositely facing decorative surface, said tie member defining:

inner opening means extending through said tie member from said underside surface to said decorative surface, and a first and second pair of first and second outer slots located on opposite sides of said tie member and said inner opening means wherein each of said first and second outer slots extends from said underside surface to said decorative surface and wherein an axis of said tie member extending through said first and second outer slots of said first pair of outer slots intersects an axis of said tie member extending through said first and second outer slots of said second pair of outer slots and wherein said axes of said pairs intersect each other at a right angle.

* * * * *